US008528361B2

(12) United States Patent
Nanda et al.

(10) Patent No.: US 8,528,361 B2
(45) Date of Patent: Sep. 10, 2013

(54) METHOD FOR ENHANCED RECOVERY OF ETHANE, OLEFINS, AND HEAVIER HYDROCARBONS FROM LOW PRESSURE GAS

(75) Inventors: Rajeev Nanda, Katy, TX (US); Rahul Singh, Katy, TX (US)

(73) Assignee: Technip USA, Houston, TX (US)

( * ) Notice: Subject to any disclaimer, the term of this patent is extended or adjusted under 35 U.S.C. 154(b) by 491 days.

(21) Appl. No.: 12/899,741

(22) Filed: Oct. 7, 2010

(65) Prior Publication Data

US 2012/0085127 A1 Apr. 12, 2012

(51) Int. Cl.
*F25J 3/02* (2006.01)

(52) U.S. Cl.
USPC ..... 62/620; 62/617; 62/618; 62/619; 62/623; 62/632

(58) Field of Classification Search
USPC ..... 62/617, 618, 619, 620, 623, 632
See application file for complete search history.

(56) References Cited

U.S. PATENT DOCUMENTS

| | | | | |
|---|---|---|---|---|
| 6,266,977 | B1 * | 7/2001 | Howard et al. | 62/623 |
| 2008/0096985 | A1 * | 4/2008 | Minta et al. | 518/705 |
| 2009/0100862 | A1 * | 4/2009 | Wilkinson et al. | 62/620 |
| 2009/0107175 | A1 * | 4/2009 | Patel et al. | 62/620 |

* cited by examiner

*Primary Examiner* — Allana Lewin
*Assistant Examiner* — Michael Schierloh
(74) *Attorney, Agent, or Firm* — R. Perry McConnell

(57) ABSTRACT

A method for recovering $C_2$ and higher weight hydrocarbons, or alternatively $C_3$ and higher weight hydrocarbons, from low pressure gas, wherein the method avoids the need to significantly compress contaminated low pressure gas in most cases, and is robust in response to pressure and temperature variations in the low pressure gas feed.

18 Claims, 3 Drawing Sheets

METHOD FOR ENHANCED RECOVERY OF ETHANE, OLEFINS, AND HEAVIER HYDROCARBONS FROM LOW PRESSURE GAS

FIELD OF THE INVENTION

The invention concerns the efficient processing of low pressure gas to recover ethane, ethylene, and higher weight hydrocarbons in a manner that both avoids the need to significantly compress low pressure gas with various contaminants in most cases, and is robust in response to pressure and temperature variations in the gas feed. The method also allows processing of low pressure gas at higher temperatures than prior methods, reducing the risk of formation of solids, such as by deposition of hydrates or the freezing of higher molecular weight components.

BACKGROUND OF THE INVENTION

Low pressure gas, for example that produced by a refinery (such as refinery off gas) or an olefins plant, is generally composed of methane, hydrogen, ethane, ethylene, propane, propene, and heavier hydrocarbons. If recovered, the hydrocarbons are valuable product which otherwise would be lost with the low pressure gas in the plant's fuel gas system.

Refinery off-gas usually contains $H_2$, CO, $CO_2$, $O_2$, $CH_4$, $C_2H_4$, $C_2H_6$, $C_3H_8$, $C_3H_6$ together with some trace impurities such as such as oxygen, ammonia, nitriles, acetylenes, sulfur compounds, butadiene, chlorides, arsenic, mercury, and water in addition to acid gases $H_2S$, $CO_2$, and COS. These low pressure gases are produced from refinery units that manufacture conversion products such as hydrotreaters, alkylation units, fluid catalytic cracking units, platformers, etc. Valuable products including hydrogen, olefins, natural gas liquids (NGL) and higher Btu fuel gas can be recovered from the low pressure gas if an low pressure gas processing unit is installed.

Similar to refinery low pressure gas, the low pressure gas from olefins plants can also be processed to recover valuable products. The low pressure gas from olefins plants typically is richer in ethylene or propylene and the low pressure gas has different species of trace impurities from those in the refinery low pressure gas.

Other plants, as well, may produce low pressure gas with $C_2$ and higher hydrocarbons, for which the method of the present invention may be useful in providing cost effective recovery of valuable $C_2$ and heavier hydrocarbons.

Currently, these valuable hydrocarbons may be recovered from the low pressure gas by at least three different methods. A circulating lean oil process may be used to absorb propylene and heavier components from refinery low pressure gases. Although the absorption process provides a reasonable recovery of propylene and heavier components, it is energy intensive and requires several pieces of operating equipment. The amount of equipment needed generally leads to an increased quantity of control loops and the need for expensive plot space.

Cryogenic expander based technologies are increasingly used in preference to the lean oil absorption methods, because these technologies provide higher ethylene and ethane recoveries. A typical cryogenic expander based process involves a series of progressive cool-down steps in plate fin heat exchangers and vapor-liquid separation steps, followed by demethanization.

Currently, turbo expanders are used in combination with external refrigeration to increase the thermodynamic efficiency of the process, thus achieving higher percentages of natural gas liquids ("NGL") recovery. The requirement of external direct refrigeration requires more equipment, controls, and instrumentation, as well as storage and handling of the refrigerant that is used. The storage of refrigerant also raises additional safety considerations due to these extra hydrocarbons being stored at the plant site.

Low pressure gas is usually available at a relatively low pressure of about eighty-five psia. To achieve higher NGL recoveries, the cryogenic expander based units require feed gas compression. Because low pressure gas is a complex mixture of hydrocarbons consisting of saturated and unsaturated paraffins, olefins, diolefins, aeromatics, and acid gas, the compression of low pressure gas is troublesome during operations. The low pressure gas composition is a mix of various gasses coming out of several different units. These units may operate at different capacities, and any one or more of them may not be operating at any particular time. Thus, an low pressure gas stream will vary appreciably in composition and flow rate depending on the source and the types of units operating at a particular time.

Generally, the compressors can be designed for a range of composition for the feed gas. However, it is difficult to predict the range of composition and flow fluctuation for the low pressure gas. Any change in composition outside the design range will result in reduced capacity or loss of recovery of NGL. Similar problems are faced in turbo expander operations. Moreover, if the content of heavier hydrocarbons increases in the low pressure gases then condensation of these hydrocarbons takes place at higher pressure in the upstream section, which if not recovered will result in loss of valuable NGL.

Various contaminants that appear in low pressure gas also cause mechanical and control problems for rotating machinery, resulting in sometimes frequent maintenance downtime and a resulting significant loss of revenue. The variations in low pressure gas feed stream molecular weights and flow characteristics also cause problems for turbo expanders used in low pressure gas processing, again often resulting in significant maintenance downtime. Similarly, unsteady operating conditions, solids formation, or thermal stresses can result in leakages in heat exchanger cores.

In an attempt to circumvent at least some of these problems, less efficient reciprocating compressors and other positive displacement machines are often used to compress the low pressure gas feed stream. However, it would be more desirable to process the inlet feed gas without compression.

A third method of recovering valuable hydrocarbons from low pressure gas is disclosed in U.S. patent application Ser. No. 12/730,424, which discloses a process that avoids the need to compress the inlet low pressure gas feed, as does the method of the present invention. However, the present method provides the flexibility of operating at higher temperatures to reduce the risk of solids formation, and can optionally be operated at lower temperatures if it is desirable to do so to increase yield.

Thus, it is desirable to provide an efficient process for low pressure gas processing that has good adaptability to the feed composition variation.

Another challenge for this recovery process is to keep the operating temperatures above certain levels to reduce the risk of blue oil formation, and the formation of hydrates and other solids. These warmer operating conditions make the process safe while still maintaining the higher recovery of valuable hydrocarbons. The reduced chances of solid formation reduce the need for maintenance while preventing long term equipment damage.

It is also an object of the invention to recover the valuable hydrocarbons ($C_2$+) from low pressure gas without, or with minimal, compression of the feed gas.

It is a further object of this invention to extract the valuable hydrocarbons from low pressure gas by using as part of the apparatus a turbo expander for which the refrigerant is product, feed gas, reflux formed during an intermediate part of the process, or a mixture of two or more of these. Using these sources for the refrigerant eliminates the need for significant storage of a specific refrigerant type. Further, use of a turbo expander in the refrigerant loop also helps to startup the plant at reduced capacity, allowing the plant to generate the required refrigerant needed to attain the full capacity of the plant.

It is yet another object of the invention to efficiently recover ethane and ethylene from the low pressure gas in a cost effective process.

SUMMARY OF THE INVENTION

Example 1

Dehydrated refinery low pressure gas generally arrives between about 90 to 110° F. and at pressures higher than about 85 psia. The bulk moisture in the feed gas can be removed by pre-chilling the gas to about 70° F. or lower in a pre-chiller, such as a shell and tube heat exchanger. The pre-chiller can be heat integrated with the NGL recovery plant, or can be operated with an external refrigerant. Alternatively, the process can be used without employing a pre-chiller.

Water from the feed gas is separated in a filter coalescer, following by dehydrating the gas in molecular sieve dehydrators.

The dehydrated feed gas is cooled to the range of about −40 to −85° F., preferably in a first plate fin heat exchanger. The resulting partially condensed hydrocarbon is separated in a low pressure separator. Vapor from the low pressure separator is fed through a second plate fin heat exchanger, preferably a brazed aluminum plate fin heat exchanger, to adjust it to about 20 to 85° F. It is then compressed to about 145 to 360 psia, preferably in a centrifugal compressor. Those of skill in the art will recognize that optimal compressor selection may involve using a multi-stage compressor.

The compressed gas is cooled in steps, first in an air cooler or cooling water heat exchanger, then in the first plate fin heat exchanger to about −90 to −119° F. This compressed and chilled vapor from the low pressure separator is fed to an absorber at the bottom. The absorber operates at about 140 to 350 psia.

The condensed liquid from the low pressure separator is divided into two streams. One portion, preferably about 20 to 60% is pumped to a distillation column operating at about 245 to 365 psia. The remaining portion is sent as heavy reflux to the top of the absorber to absorb $C_2$+ from the compressed and chilled vapor from the low pressure separator.

Liquid leaving the bottom of the absorber column is rich in $C_2$+. A part of this liquid, preferably about 20 to 60%, is pumped to the distillation column as a reflux feed to the top-most tray. The remainder of the liquid is heated, preferably in the first plate fin heat exchanger, to about 10 to 85° F. and is then fed to the distillation column.

Vapor leaving the top of the absorber column at about −53 to −95° F. is cooled to −90 to −119° F., again preferably in the first plate fin heat exchanger to condense the remaining $C_2$+ content in the gas. The resulting partially condensed fluid stream is separated in a high pressure separator. Fluid leaving the bottom of the high pressure separator is pumped to the distillation column at the top most tray.

The distillation column operates at about 255 to 365 psia at the bottom and 245 to 360 psia at the top. Overhead vapor from the distillation column depressurized via a control valve, combined with the separated vapor from the high pressure separator, then is preferably fed through both the first plate fin heat exchanger and the second plate fin heat exchanger to adjust its temperature to about 80 to 103° F. This vapor feed is then sent out as lean gas at a pressure at least equal to that of the inlet gas.

As an option, an expander can be used instead of control valve to let down the pressure of the lean gas stream to 65 to 125 psia. Utilizing an expander for pressure let down can result in power savings when the absorber and distillation column are operated at the higher ends of the desired pressure ranges.

The distillation column bottom temperature is maintained at about 85 to 105° F., allowing the distillation column reboiler to be utilized to cooling the refrigerant in the closed loop refrigeration cycle (discussed below) after its final stage of compression. $C_2$+ product is recovered from the distillation column bottom. Refrigeration for this process is preferably provided by a closed loop turbo expander cycle. The refrigerant can be made by combining a portion of the vapor from the low pressure separator and the distillation column with a portion of the $C_2$+ bottom product from the distillation column. However, other refrigerants can be used without departing from the spirit of the invention.

As one option, part of the bottom product from the distillation column may be flashed to a low pressure of about 45 to 155 psia and used as a refrigerant in the first or second plate fin heat exchangers. Utilizing this option will reduce the requirement for external refrigeration, resulting in potential power savings. An embodiment of this option is discussed in conjunction with Example 3, below.

The refrigerant is compressed, preferably in a centrifugal compressor, to about 290 to 400 psia and cooled in steps, first in an air cooler or cooling water heat exchanger, and then in the distillation column reboiler. Those of skill in the art will recognize that the centrifugal compressor may be a multi-stage compressor. The resulting cooled refrigerant is a two phase mixture, which is separated in a refrigerant separator. Separated refrigerant liquid is further cooled in the second plate fin heat exchanger to about −50 to −85° F.

Refrigerant vapor from the refrigerant separator is expanded in a turbo expander (preferably associated with a turbo compressor) to a pressure of about 120 to 150 psia. The expanded vapor may then be used to cool the inlet gas feed in the pre-chiller, and then cooled to about −98 to −105° F. in the first plate fin heat exchanger. This cooling results in a two phase fluid, which is separated in a vertical drum. Both the liquid and vapor from the vertical drum are flashed to about 50 to 65 psia by means of control valves. Both streams are combined with the cooled refrigerant liquid stream exiting the second plate fin heat exchanger, which is also brought to about 50 to 65 psia by means of a control valve. The combined refrigerant streams are fed to the first plate fin heat exchanger to provide the refrigeration for the process.

Upon exiting the first plate fin heat exchanger, the refrigerant is at about 70 to 102° F. and is fed to a turbo compressor. The partially compressed gas from the turbo compressor is returned to the centrifugal compressor to complete the refrigerant loop.

Example 2

In an alternative embodiment of the above-described process, the process may be carried out as previously described, but with the distillation column overhead vapor redirected. Rather than being combined with the vapor from the high pressure separator, vapor leaving the top of the absorber column at about −53 to −95° F. is combined with the distillation column overhead vapor, and the combined stream is then cooled to −90 to −119° F., again preferably in the first plate fin heat exchanger to condense the remaining $C_2$+ content in the gas. The resulting partially condensed fluid stream is separated in a high pressure separator.

Separated vapor from the high pressure separator is preferably fed through both the first plate fin heat exchanger and the second plate fin heat exchanger to adjust its temperature to about 80 to 103° F. This vapor feed is then sent out as lean gas at a pressure at least equal to that of the inlet gas.

Example 3

This example is modified to provide recovery of $C_3$ and higher hydrocarbons. Dehydrated refinery low pressure gas generally arrives between about 90 to 110° F. and at pressures higher than about 85 psia. The bulk moisture in the feed gas can be removed by pre-chilling the gas to about 70° F. or lower. The pre-chiller can be heat integrated with the NGL recovery plant, or can be operated with an external refrigerant. Alternatively, the process can be used without employing a pre-chiller.

Water from the feed gas is separated in a filter coalescer, following by dehydrating the gas in molecular sieve dehydrator.

The dehydrated feed gas is cooled to the range of about −40 to −85° F., preferably in a first plate fin heat exchanger. The resulting partially condensed hydrocarbon is separated in a low pressure separator. Vapor from the low pressure separator is fed through a second plate fin heat exchanger, preferably a brazed aluminum plate fin heat exchanger, to adjust it to about 20 to 85° F. The vapor feed passes through first suction drum. The vapor feed leaves first suction drum and is then compressed to about 120 to 240 psia in first compressor, which is preferably a centrifugal compressor. Those of skill in the art will recognize that optimal compressor selection may involve using a multi-stage compressor.

The compressed gas is cooled in steps, first in a third heat exchanger, then in the first plate fin heat exchanger to about −50 to −104° F. This compressed and chilled vapor from the low pressure separator is fed to an absorber at the bottom. The absorber operates at about 100 to 230 psia.

The condensed liquid from the low pressure separator is pumped through the first plate fin heat exchanger, where it is heated to about 10 to 85° F. This stream is then fed to a distillation column which operates at about 120 to 320 psia. The distillation column comprises a reboiler.

Liquid leaving the bottom of the absorber is rich in $C_3$+. The separated liquid is pumped by a second pump through a second control valve and a fourth heat exchanger, where it is heated to −7 to 15° F. The fourth heat exchanger can be a shell and tube type heat exchanger. After leaving fourth heat exchanger, the liquid is fed to the distillation column as a reflux feed to the top-most tray.

Vapor leaving the top of the absorber at about −8 to −104° F. is preferably fed through both the first plate fin heat exchanger and the second plate fin heat exchanger to heat it to about 80 to 85° F. This vapor is then sent out as lean gas at a pressure at least equal to that of that of the inlet gas.

The distillation column operates at about 120 to 320 psia at the bottom and 110 to 310 psia at the top. Overhead vapor from the distillation column passes through a control valve, then is preferably chilled in the second plate fin heat exchanger to adjust its temperature to about −5 to 15° F. The resulting two phase mixture is separated in a reflux drum. Separated liquid from the reflux drum is pumped by third pump to the distillation column at the top.

Vapor leaving the reflux drum is cooled in a fourth heat exchanger to about −1 to −15° F. and then further cooled in the second plate fin heat exchanger to about −15 to −25° F. A bypass valve may be fully opened, partially opened or fully closed as desired to allow part of the vapor stream to bypass the second plate fin heat exchanger as needed to control the temperature. This vapor stream is finally chilled to about −55 to −80° F. in the first plate fin heat exchanger, then fed via a control valve to the top of the absorber.

The distillation column bottom temperature is maintained at about 85 to 160° F. $C_3$+ product is recovered from the distillation column bottom.

Prechilling can be provided by cooling the $C_3$+ product from the bottom of the distillation column in a fifth heat exchanger, which can be a water cooler, air cooler, or other appropriate heat exchanger, then flashing the cooled $C_3$+ product via a flash valve to about 45 to 75 psia. The flashed $C_3$+ product exchanges heat in the prechiller with the arriving low pressure gas. On exiting the prechiller, the flashed $C_3$+ product is a two-phase mixture that is fed to a product separator.

Vapor from the separator is compressed to about 180 to 220 psia and cooled in a product heat exchanger to completely condense the vapor. The product heat exchanger may be a water cooler, air cooler, or other appropriate heat exchanger. This condensed vapor is fed to a product surge drum.

Liquid from the product separator is pumped by a fourth pump to the product surge drum. The content of the product surge drum is the final $C_3$+ product.

Utilization of flashed product for refrigeration can provide power savings by reducing the need for external refrigeration. Those of skill in the art will recognize that flashed product may be used in the pre-chiller, or alternatively the first or second plate fin heat exchangers, or in other heat exchangers as desired. Additionally, this alternative embodiment may be utilized in the configurations of Example 1 and Example 2, above.

Other refrigeration for this process is preferably provided by a closed loop turbo expander cycle. The refrigerant can be made by combining a portion of the vapor from the low pressure separator and the distillation column with a portion of the $C_3$+ bottom product from the distillation column. However, other refrigerants can be used without departing from the spirit of the invention.

The refrigerant is compressed, in a refrigerant compressor, preferably a centrifugal compressor, to about 290 to 400 psia and cooled in a refrigerant heat exchanger, preferably an air cooler or cooling water heat exchanger. Those of skill in the art will recognize that the refrigerant compressor may be a multi-stage compressor. The resulting cooled refrigerant is a two phase mixture, which is separated in a refrigerant separator. Separated refrigerant liquid is further cooled in the second plate fin heat exchanger to about −50 to −85° F.

Refrigerant vapor from the refrigerant separator is expanded in a turbo expander (preferably associated with a turbo compressor) to a pressure of about 120 to 150 psia. The expanded vapor may then be cooled to about −98 to −105° F. in the first plate fin heat exchanger. This cooling results in a two phase fluid, which is separated in a vertical drum. Both the liquid and vapor from the vertical drum are flashed to about 50 to 65 psia by means of fourth and fifth control valves. Both streams are combined with the cooled refrigerant liquid stream exiting the second plate fin heat exchanger, which is also brought to about 50 to 65 psia by means of a sixth control valve. The combined refrigerant streams are fed to the first plate fin heat exchanger to provide the refrigeration for the process.

Upon exiting the first plate fin heat exchanger, the refrigerant is at about 70 to 102° F. and passes through first refrigerant suction drum. The vapor from first refrigerant suction drum is fed to a turbo compressor. The partially compressed gas from the turbo compressor passes through second refrigerant suction drum. The vapor from the second refrigerant suction drum is returned to the refrigerant compressor to complete the refrigerant loop.

DETAILED DESCRIPTION

Example 1

Figure 1A:
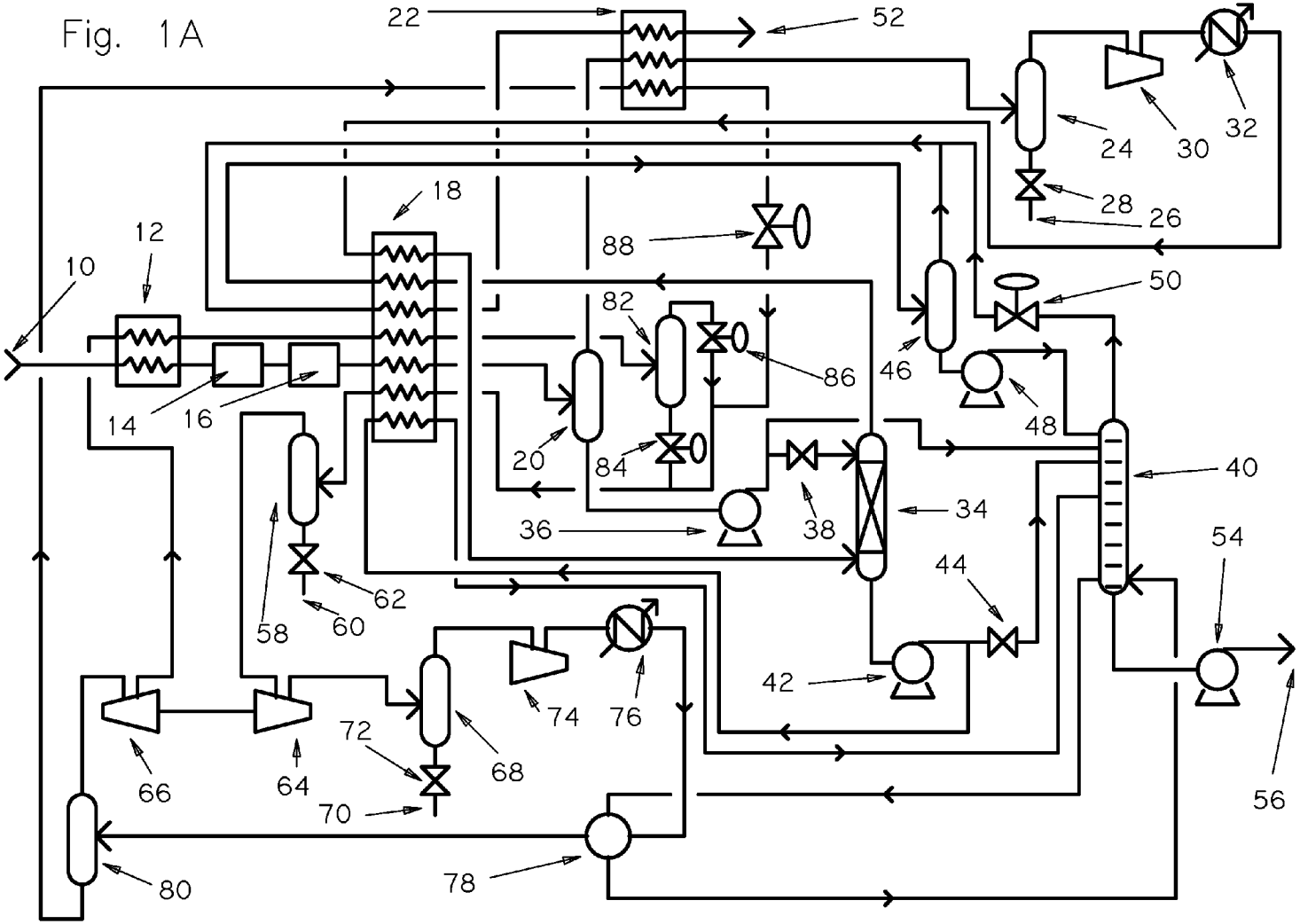
FIG. 1A is a schematic representation of one embodiment of the present invention.

Referring to FIG. 1A, one embodiment of the method of the present invention is schematically shown. Dehydrated refinery low pressure gas generally arrives at low pressure gas inlet 10 between about 90 to 110° F. and at pressures higher than about 85 psia. The bulk moisture in the feed gas can be removed by pre-chilling the gas in pre-chiller 12 to about 70° F. or lower, such as a shell and tube heat exchanger. The pre-chiller 12 can be heat integrated with the NGL recovery plant, or can be operated with an external refrigerant. Alternatively, the process can be used without employing a pre-chiller 12.

Water from the feed gas is separated in a filter coalescer 14, following by dehydrating the gas in molecular sieve dehydrator 16.

The dehydrated feed gas is cooled to the range of about −40 to −85° F., preferably in a first plate fin heat exchanger 18. The resulting partially condensed hydrocarbon is separated in a low pressure separator 20. Vapor from the low pressure separator 20 is fed through a second plate fin heat exchanger 22, preferably a brazed aluminum plate fin heat exchanger, to adjust it to about 20 to 85° F. The vapor feed passes through first suction drum 24. First suction drum 24 comprises a first suction drum outlet 26 which is controlled by normally-closed first suction drum outlet valve 28. The vapor feed leaves first suction drum 24 and is then compressed to about 145 to 360 psia in first compressor 30, which is preferably a centrifugal compressor. Those of skill in the art will recognize that optimal compressor selection may involve using a multi-stage compressor.

The compressed gas is cooled in steps, first in third heat exchanger 32, preferably an air cooler or cooling water heat exchanger, then in the first plate fin heat exchanger 18 to about −90 to −119° F. This compressed and chilled vapor from the low pressure separator is fed to an absorber 34 at the bottom. The absorber 34 operates at about 140 to 350 psia.

The condensed liquid from the low pressure separator 20 is divided into two streams. One portion, preferably about 20 to 60% is pumped via first pump 36 to a distillation column 40 operating at about 245 to 365 psia. The remaining portion is sent through first control valve 38 as heavy reflux to the top of the absorber 34 to absorb $C_2$+ from the compressed and chilled vapor from the low pressure separator 20.

Liquid leaving the bottom of the absorber 34 is rich in $C_2$+. A part of this liquid, preferably about 20 to 60%, is pumped by second pump 42 through second control valve 44 to the distillation column 40 as a reflux feed to the top-most tray. The remainder of the liquid is heated, preferably in the first plate fin heat exchanger 18, to about 10 to 85° F. and is then fed to the distillation column 40 at about the fifteenth tray.

Vapor leaving the top of the absorber 34 at about −53 to −95° F. is cooled to −90 to −119° F., again preferably in the first plate fin heat exchanger 18, to condense the remaining $C_2$+ content in the gas. The resulting partially condensed fluid stream is separated in high pressure separator 46. Fluid leaving the bottom of the high pressure separator is pumped via third pump 48 to the distillation column 40 at the top most tray.

The distillation column 40 operates at about 255 to 365 psia at the bottom and 245 to 360 psia at the top. Overhead vapor from the distillation column 40 passes through control valve 50, then is combined with the separated vapor from the high pressure separator 46. The combined vapor feed then is preferably fed through both the first plate fin heat exchanger 18 and the second plate fin heat exchanger 22 to adjust its temperature to about 80 to 103° F. This vapor feed is then sent out as lean gas at lean gas outlet 52 at a pressure at least equal to that of the inlet gas.

The distillation column 40 bottom temperature is maintained at about 85 to 105° F., allowing the distillation column reboiler 78 to be utilized to cooling the refrigerant in the closed loop refrigeration cycle (discussed below) after its final stage of compression. $C_2$+ product is recovered from the distillation column bottom, and is pumped by fourth pump 54 to the $C_2$+ product outlet 56.

Refrigeration for this process is preferably provided by a closed loop turbo expander cycle. The refrigerant can be made by combining a portion of the vapor from the low pressure separator 20 and the distillation column 40 with a portion of the $C_2$+ bottom product from the distillation column 40. However, other refrigerants can be used without departing from the spirit of the invention.

The refrigerant is compressed, preferably in refrigerant compressor 74, preferably a centrifugal compressor, to about 290 to 400 psia and cooled in steps, first in refrigerant heat exchanger 76, preferably an air cooler or cooling water heat exchanger, and then in the distillation column reboiler 78. Those of skill in the art will recognize that the refrigerant compressor 74 may be a multi-stage compressor. The resulting cooled refrigerant is a two phase mixture, which is separated in a refrigerant separator 80. Separated refrigerant liquid is further cooled in the second plate fin heat exchanger 22 to about −50 to −85° F.

Refrigerant vapor from the refrigerant separator 80 is expanded in a turbo expander 66 (preferably associated with a turbo compressor 64) to a pressure of about 120 to 150 psia. The expanded vapor may then be used to cool the inlet gas feed in the pre-chiller 12, and then cooled to about −98 to −109° F. in the first plate fin heat exchanger 18. This cooling results in a two phase fluid, which is separated in a vertical drum 82. Both the liquid and vapor from the vertical drum 82 are flashed to about 50 to 65 psia by means of fourth and fifth control valves 84, 86. Both streams are combined with the cooled refrigerant liquid stream exiting the second plate fin heat exchanger 22, which is also brought to about 50 to 65 psia by means of a sixth control valve 88. The combined refrigerant streams are fed to the first plate fin heat exchanger 18 to provide the refrigeration for the process.

Upon exiting the first plate fin heat exchanger 18, the refrigerant is at about 70 to 102° F. and passes through first refrigerant suction drum 58. First refrigerant suction drum 58 comprises first refrigerant suction drum outlet 60 which is controlled by normally closed first refrigerant suction drum outlet valve 62. The vapor from first refrigerant suction drum 58 is fed to turbo compressor 64. The partially compressed gas from turbo compressor 64 passes through second refrigerant suction drum 68. Second refrigerant suction drum 68 comprises second refrigerant suction drum outlet 70 which is controlled by normally closed second refrigerant suction drum outlet valve 72. The vapor from second refrigerant suction drum 68 is returned to the refrigerant compressor 74 to complete the refrigerant loop.

Example 2

Figure 1B:
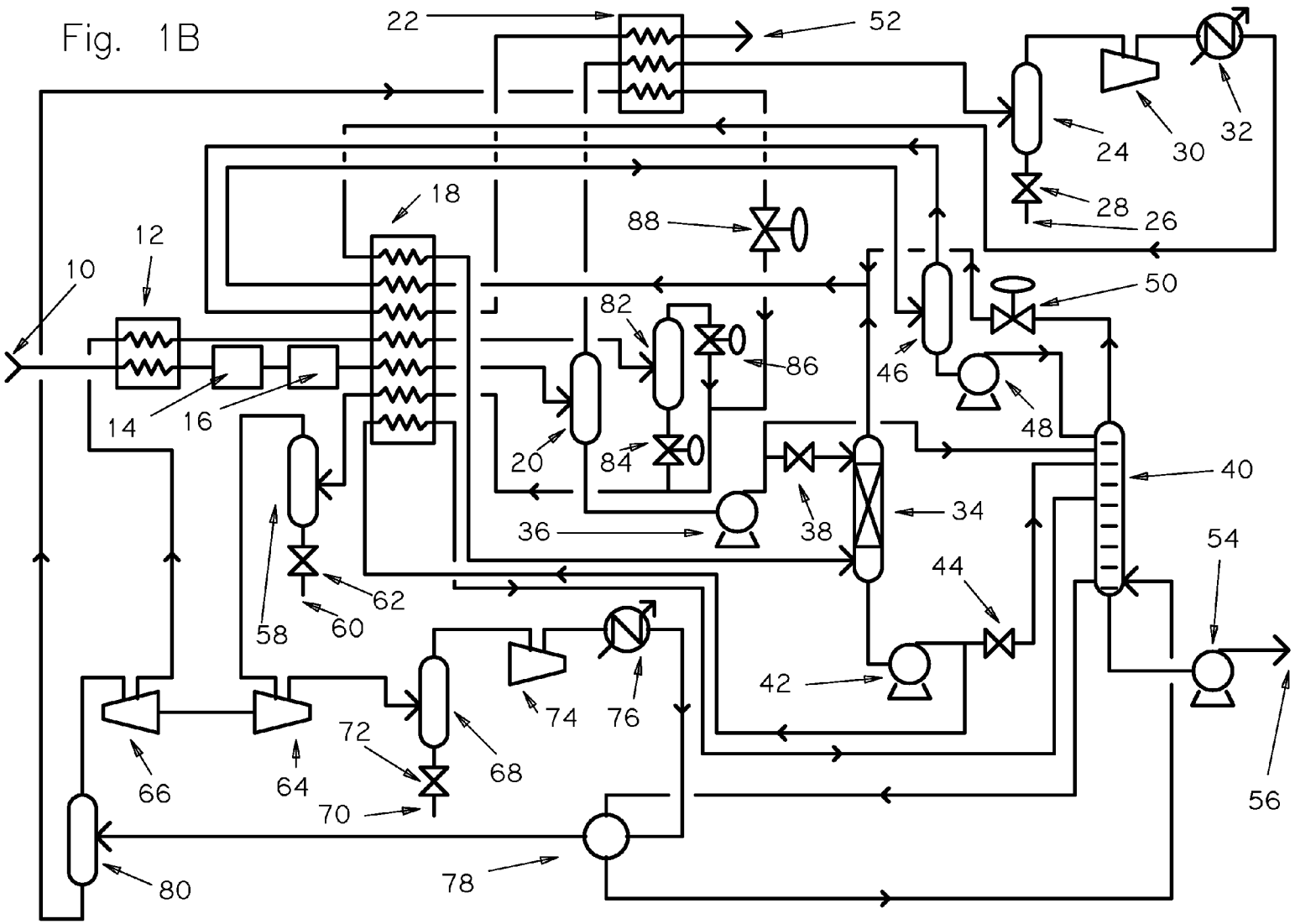
FIG. 1B is a schematic representation of an alternative embodiment of the present invention.

Referring to FIG. 1B, an alternative embodiment of the method of the present invention is schematically shown. Dehydrated refinery low pressure gas generally arrives at low pressure gas inlet 10 between about 90 to 110° F. and at pressures higher than about 85 psia. The bulk moisture in the feed gas can be removed by pre-chilling the gas in pre-chiller 12 to about 70° F. or lower, such as a shell and tube heat exchanger. The pre-chiller 12 can be heat integrated with the NGL recovery plant, or can be operated with an external refrigerant. Alternatively, the process can be used without employing a pre-chiller 12.

Water from the feed gas is separated in a filter coalescer 14, following by dehydrating the gas in molecular sieve dehydrator 16.

The dehydrated feed gas is cooled to the range of about −40 to −85° F., preferably in a first plate fin heat exchanger 18. The resulting partially condensed hydrocarbon is separated in a low pressure separator 20. Vapor from the low pressure separator 20 is fed through a second plate fin heat exchanger 22, preferably a brazed aluminum plate fin heat exchanger, to adjust it to about 20 to 85° F. The vapor feed passes through first suction drum 24. First suction drum 24 comprises a first suction drum outlet 26 which is controlled by normally-closed first suction drum outlet valve 28. The vapor feed leaves first suction drum 24 and is then compressed to about 145 to 360 psia in first compressor 30, which is preferably a centrifugal compressor. Those of skill in the art will recognize that optimal compressor selection may involve using a multi-stage compressor.

The compressed gas is cooled in steps, first in third heat exchanger 32, preferably an air cooler or cooling water heat exchanger, then in the first plate fin heat exchanger 18 to about −90 to −119° F. This compressed and chilled vapor from the low pressure separator is fed to an absorber 34 at the bottom. The absorber 34 operates at about 250 to 350 psia.

The condensed liquid from the low pressure separator 20 is divided into two streams. One portion, preferably about 20 to 60% is pumped via first pump 36 to a distillation column 40 operating at about 245 to 365 psia. The remaining portion is sent through first control valve 38 as heavy reflux to the top of the absorber 34 to absorb $C_2$+ from the compressed and chilled vapor from the low pressure separator 20.

Liquid leaving the bottom of the absorber 34 is rich in $C_2$+. A part of this liquid, preferably about 20 to 60%, is pumped by second pump 42 through second control valve 44 to the distillation column 40 as a reflux feed to the top-most tray. The remainder of the liquid is heated, preferably in the first plate fin heat exchanger 18, to about 10 to 85° F. and is then fed to the distillation column 40 at about the fifteenth tray.

The distillation column 40 operates at about 255 to 365 psia at the bottom and 245 to 360 psia at the top. Rather than being combined with the vapor from the high pressure separator 46, the distillation column 40 overhead vapor passes through control valve 50, and is then combined with vapor leaving the top of the absorber 34 at about −53 to −95° F., and the combined stream is then cooled to −90 to −119° F., again preferably in the first plate fin heat exchanger 18, to condense the remaining $C_2$+ content in the gas. The resulting partially condensed fluid stream is separated in high pressure separator 46. Fluid leaving the bottom of the high pressure separator is pumped via third pump 48 to the distillation column 40 at the top most tray.

Separated vapor from the high pressure separator 46 is preferably fed through both the first plate fin heat exchanger 18 and the second plate fin heat exchanger 22 to adjust its temperature to about 80 to 103° F. This vapor feed is then sent out as lean gas at lean gas outlet 52 at a pressure at least equal to that of the inlet gas.

The distillation column 40 bottom temperature is maintained at about 85 to 105° F., allowing the distillation column reboiler 78 to be utilized to cooling the refrigerant in the closed loop refrigeration cycle (discussed below) after its final stage of compression. $C_2$+ product is recovered from the distillation column bottom, and is pumped by fourth pump 54 to the $C_2$+ product outlet 56.

Refrigeration for this process is preferably provided by a closed loop turbo expander cycle. The refrigerant can be made by combining a portion of the vapor from the low pressure separator 20 and the distillation column 40 with a portion of the $C_2$+ bottom product from the distillation column 40. However, other refrigerants can be used without departing from the spirit of the invention.

The refrigerant is compressed, preferably in refrigerant compressor 74, preferably a centrifugal compressor, to about 290 to 400 psia and cooled in steps, first in refrigerant heat exchanger 76, preferably an air cooler or cooling water heat exchanger, and then in the distillation column reboiler 78. Those of skill in the art will recognize that the refrigerant compressor 74 may be a multi-stage compressor. The resulting cooled refrigerant is a two phase mixture, which is separated in a refrigerant separator 80. Separated refrigerant liquid is further cooled in the second plate fin heat exchanger 22 to about −50 to −85° F.

Refrigerant vapor from the refrigerant separator 80 is expanded in a turbo expander 66 (preferably associated with a turbo compressor 64) to a pressure of about 120 to 150 psia. The expanded vapor may then be used to cool the inlet gas feed in the pre-chiller 12, and then cooled to about −98 to −109° F. in the first plate fin heat exchanger 18. This cooling results in a two phase fluid, which is separated in a vertical drum 82. Both the liquid and vapor from the vertical drum 82 are flashed to about 50 to 65 psia by means of fourth and fifth control valves 84, 86. Both streams are combined with the cooled refrigerant liquid stream exiting the second plate fin heat exchanger 22, which is also brought to about 50 to 65 psia by means of a sixth control valve 88. The combined refrigerant streams are fed to the first plate fin heat exchanger 18 to provide the refrigeration for the process.

Upon exiting the first plate fin heat exchanger 18, the refrigerant is at about 70 to 102° F. and passes through first refrigerant suction drum 58. First refrigerant suction drum 58 comprises first refrigerant suction drum outlet 60 which is controlled by normally closed first refrigerant suction drum outlet valve 62. The vapor from first refrigerant suction drum 58 is fed to turbo compressor 64. The partially compressed gas from turbo compressor 64 passes through second refrigerant suction drum 68. Second refrigerant suction drum 68 comprises second refrigerant suction drum outlet 70 which is controlled by normally closed second refrigerant suction drum outlet valve 72. The vapor from second refrigerant suction drum 68 is returned to the refrigerant compressor 74 to complete the refrigerant loop.

Example 3

Figure 1C:
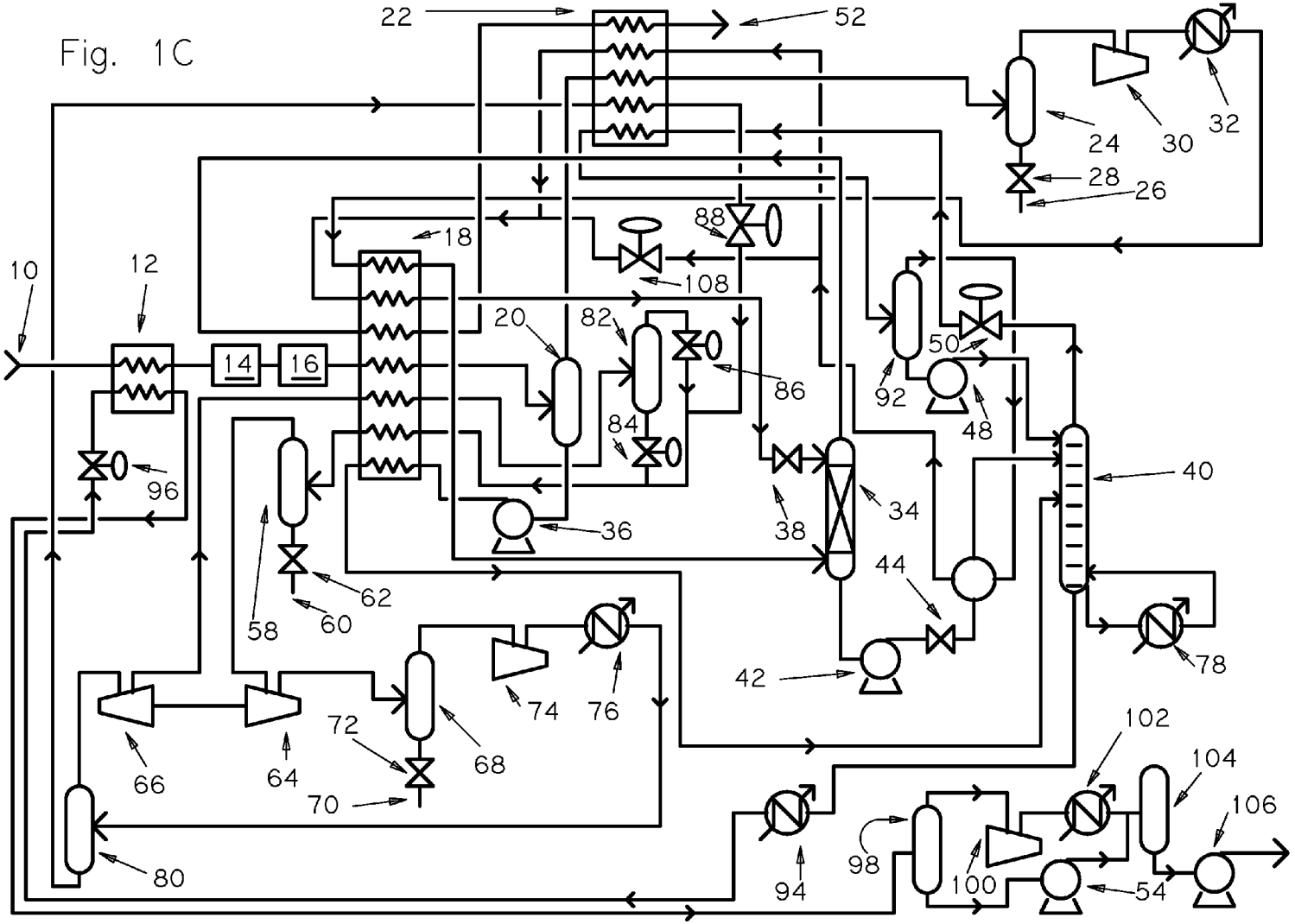
FIG. 1C is a schematic representation of another alternative embodiment of the present invention.

Referring to FIG. 1C, one embodiment of the method of the present invention is schematically shown. This example is modified to provide recovery of $C_3$ and higher hydrocarbons. Dehydrated refinery low pressure gas generally arrives at low pressure gas inlet 10 between about 90 to 110° F. and at pressures higher than about 85 psia. The bulk moisture in the feed gas can be removed by pre-chilling the gas in pre-chiller 12 to about 70° F. or lower, such as a shell and tube heat exchanger. The pre-chiller 12 can be heat integrated with the NGL recovery plant, or can be operated with an external refrigerant. Alternatively, the process can be used without employing a pre-chiller 12.

Water from the feed gas is separated in a filter coalescer 14, following by dehydrating the gas in molecular sieve dehydrator 16.

The dehydrated feed gas is cooled to the range of about −40 to −85° F., preferably in a first plate fin heat exchanger 18. The resulting partially condensed hydrocarbon is separated in a low pressure separator 20. Vapor from the low pressure separator 20 is fed through a second plate fin heat exchanger 22, preferably a brazed aluminum plate fin heat exchanger, to adjust it to about 20 to 85° F. The vapor feed passes through first suction drum 24. First suction drum 24 comprises a first suction drum outlet 26 which is controlled by normally-closed first suction drum outlet valve 28. The vapor feed leaves first suction drum 24 and is then compressed to about 120 to 240 psia in first compressor 30, which is preferably a centrifugal compressor. Those of skill in the art will recognize that optimal compressor selection may involve using a multi-stage compressor.

The compressed gas is cooled in steps, first in third heat exchanger 32, preferably an air cooler or cooling water heat exchanger, then in the first plate fin heat exchanger 18 to about −50 to −104° F. This compressed and chilled vapor from the low pressure separator is fed to an absorber 34 at the bottom. The absorber 34 operates at about 100 to 230 psia.

The condensed liquid from the low pressure separator 20 is pumped via first pump 36 through first plate fin heat exchanger 18, where it is heated to about 10 to 85° F. This stream is then fed to distillation column 40. Distillation column 40 comprises reboiler 78.

Liquid leaving the bottom of the absorber 34 is rich in $C_3$+. The separated liquid is pumped by second pump 42 through second control valve 44 and fourth heat exchanger 90, where it is heated to −7 to 15° F. Fourth heat exchanger 90 can be a shell and tube type heat exchanger. After leaving fourth heat exchanger 90, the liquid is fed to the distillation column 40 as a reflux feed to the top-most tray.

Vapor leaving the top of the absorber 34 at about −8 to −104° F. is preferably fed through both the first plate fin heat exchanger 18 and the second plate fin heat exchanger 22 to heat it to about 80 to 85° F. This vapor is then sent out as lean gas at lean gas outlet 52 at a pressure at least equal to that of that of the gas arriving at low pressure gas inlet 10.

The distillation column 40 operates at about 120 to 320 psia at the bottom and 110 to 310 psia at the top. Overhead vapor from the distillation column 40 passes through control valve 50, then is preferably chilled in the second plate fin heat exchanger 22 to adjust its temperature to about −5 to 15° F. The resulting two phase mixture is separated in reflux drum 92. Separated liquid from reflux drum 92 is pumped by third pump 48 to the distillation column 40 at the top.

Vapor leaving reflux drum 92 is cooled in fourth heat exchanger 90 to about −1 to −15° F. and then further cooled in second plate fin heat exchanger 22 to about −15 to −25° F. Bypass valve 108 may be fully opened, partially opened or fully closed as desired to allow part of the vapor stream to bypass the second plate fin heat exchanger 22 as needed to control the temperature. This vapor stream is finally chilled to about −55 to −80° F. in the first plate fin heat exchanger 18, then fed via control valve 38 to the top of absorber 34.

The distillation column 40 bottom temperature is maintained at about 85 to 160° F. $C_3$+ product is recovered from the distillation column bottom.

Prechilling in the prechiller 12 can be provided by cooling the $C_3$+ product from the bottom of the distillation column 40 in fifth heat exchanger 94, which can be a water cooler, air cooler, or other appropriate heat exchanger, then flashing the cooled $C_3$+ product via flash valve 96 to about 45 to 75 psia. The flashed $C_3$+ product exchanges heat in prechiller 12 with the low pressure gas entering through low pressure gas inlet 10. On exiting prechiller 12, the flashed $C_3$+ product is a two-phase mixture that is fed to product separator 98.

Vapor from separator 98 is compressed in product compressor 100 to about 180 to 220 psia and cooled in product heat exchanger 102 to completely condense the vapor. Product heat exchanger 102 may be a water cooler, air cooler, or other appropriate heat exchanger. This condensed vapor is fed to product surge drum 104. Liquid from product separator 98 is pumped by fourth pump 54 to the product surge drum 104. Product from product surge drum 104 is pumped out via product pump 106.

Utilization of flashed product for refrigeration can provide power savings by reducing the need for external refrigeration. Those of skill in the art will recognize that flashed product may be used in the pre-chiller 12, or alternatively the first or second plate fin heat exchangers 18, 22, or in other heat exchangers as desired. Additionally, this alternative embodiment may be utilized in the configurations of Example 1 and Example 2, above.

Other refrigeration for this process is preferably provided by a closed loop turbo expander cycle. The refrigerant can be made by combining a portion of the vapor from the low pressure separator 20 and the distillation column 40 with a portion of the $C_3$+ bottom product from the distillation column 40. However, other refrigerants can be used without departing from the spirit of the invention.

The refrigerant is compressed, preferably in refrigerant compressor 74, preferably a centrifugal compressor, to about 290 to 400 psia and cooled in refrigerant heat exchanger 76, preferably an air cooler or cooling water heat exchanger. Those of skill in the art will recognize that the refrigerant compressor 74 may be a multi-stage compressor. The resulting cooled refrigerant is a two phase mixture, which is separated in a refrigerant separator 80. Separated refrigerant liquid is further cooled in the second plate fin heat exchanger 22 to about −50 to −85° F.

Refrigerant vapor from the refrigerant separator 80 is expanded in a turbo expander 66 (preferably associated with a turbo compressor 64) to a pressure of about 120 to 150 psia. The expanded vapor may then be used to cool the inlet gas feed in the pre-chiller 12, and then cooled to about −98 to −105° F. in the first plate fin heat exchanger 18, or it may be directly cooled in the first plate heat exchanger 18. This cooling results in a two phase fluid, which is separated in a vertical drum 82. Both the liquid and vapor from the vertical drum 82 are flashed to about 50 to 65 psia by means of fourth and fifth control valves 84, 86. Both streams are combined with the cooled refrigerant liquid stream exiting the second plate fin heat exchanger 22, which is also brought to about 50 to 65 psia by means of a sixth control valve 88. The combined refrigerant streams are fed to the first plate fin heat exchanger 18 to provide the refrigeration for the process.

Upon exiting the first plate fin heat exchanger 18, the refrigerant is at about 70 to 102° F. and passes through first refrigerant suction drum 58. First refrigerant suction drum 58 comprises first refrigerant suction drum outlet 60 which is controlled by normally closed first refrigerant suction drum outlet valve 62. The vapor from first refrigerant suction drum 58 is fed to turbo compressor 64. The partially compressed gas from turbo compressor 64 passes through second refrigerant suction drum 68. Second refrigerant suction drum 68 comprises second refrigerant suction drum outlet 70 which is controlled by normally closed second refrigerant suction drum outlet valve 72. The vapor from second refrigerant suction drum 68 is returned to the refrigerant compressor 74 to complete the refrigerant loop.

Those of skill in the art will recognize that the above process can operate over a range of temperatures and pressures, and that the parameters provided above are by way of example only and are not considered to be limiting of the invention as described in the claims below.

We claim:

1. A method for processing a low pressure gas inlet stream to recover C2 and higher weight hydrocarbons, comprising the steps of dehydrating said low pressure gas inlet stream, cooling said low pressure gas inlet stream to form a partially condensed hydrocarbon feed, separating a first liquid stream and a first vapor stream from said partially condensed hydrocarbon feed, compressing said first vapor stream, separating said first liquid stream into a first part and a second part, using said first part of said first liquid stream in an absorber to absorb $C_2$ and higher weight hydrocarbons from said compressed first vapor stream, partially condensing a top product from said absorber, separating said partially condensed absorber top product into a second liquid stream and a second vapor stream, separating a bottom product from said absorber into a first part and a second part, heating said first part of said bottom product, distilling said heated first part of said bottom product in a distillation column, utilizing said second part of said first liquid stream, said second liquid stream, and said second part of said bottom product as a top feed to said distillation column, and recovering $C_2$ and higher weight hydrocarbons as bottom product from said distillation column.

2. The method of claim 1, additionally comprising the step of pre-chilling said low pressure gas inlet stream prior to the step of dehydrating said low pressure gas inlet stream.

3. The method of claim 1, additionally comprising the steps of recovering top vapor from said distillation column, mixing said top vapor from said distillation column with said second vapor stream, to form a lean gas stream, and heating said lean gas stream to provide a lean gas output.

4. The method of claim 1, additionally comprising the steps of recovering top vapor from said distillation column, mixing said top vapor from said distillation column with the top product from said absorber before the step of partially condensing a top product from said absorber, and heating said second vapor stream to provide a lean gas output.

5. The method of claim 1, additionally comprising the step of providing a closed loop refrigeration system to provide refrigeration for the process.

6. The method of claim 1, additionally comprising the step of providing a closed loop turbo expander refrigeration system to provide refrigeration for the process.

7. The method of claim 1, wherein the step of cooling said low pressure gas inlet stream to form a partially condensed hydrocarbon feed comprises the step of cooling said low pressure gas inlet stream to about −40 to −85° F.

8. The method of claim 1, wherein the step of compressing said first vapor stream comprises the step of compressing said first vapor stream to about 145 to 360 psia.

9. The method of claim 1, additionally comprising the step of warming said first vapor stream to about 20 to 85° F. prior to the step of compressing said first vapor stream.

10. The method of claim 1, additionally comprising the step of cooling said first compressed vapor stream to about −90 to −119° F. prior to the step of using said first part of said first liquid stream in an absorber to absorb $C_2$ and higher weight hydrocarbons from said compressed first vapor stream.

11. The method of claim 1, additionally comprising the step of operating said absorber at about 140 to 350 psia.

12. The method of claim 1, wherein the step of separating said first liquid stream into a first part and a second part comprises the step of using about 20 to 60% of said first liquid stream to compose said second part of said first liquid stream.

13. The method of claim 1, wherein the step of separating a bottom product from said absorber into a first part and a second part comprises the step of using about 20 to 60% of said absorber bottom product to compose said second part of said absorber bottom product.

14. The method of claim 1, wherein the step of heating said first part of said bottom product comprises the step of heating said first part to about 10 to 85° F.

15. The method of claim 1, additionally comprising the step of operating said distillation column at about 255 to 365 psia at the bottom.

16. The method of claim 1, additionally comprising the step of operating said distillation column at about 245 to 360 psia at the top.

17. The method of claim 1, additionally comprising the step of maintaining said distillation column bottom temperature at about 85 to 105° F.

18. The method of claim 1, additionally comprising the step of flashing part of said bottom product for use as a refrigerant.

* * * * *